US010590612B2

(12) United States Patent
Frankemölle et al.

(10) Patent No.: US 10,590,612 B2
(45) Date of Patent: Mar. 17, 2020

(54) ACTUATING UNIT FOR LOCKING A COMPONENT OF A CONSTRUCTION MACHINE

(71) Applicant: Wirtgen GmbH, Windhagen (DE)

(72) Inventors: Markus Frankemölle, Hennef (DE); Ronald Lull, Königswinter (DE); Cyrus Barimani, Königswinter (DE)

(73) Assignee: Wirtgen GmbH (DE)

( * ) Notice: Subject to any disclaimer, the term of this patent is extended or adjusted under 35 U.S.C. 154(b) by 189 days.

(21) Appl. No.: 15/820,755

(22) Filed: Nov. 22, 2017

(65) Prior Publication Data

US 2018/0163351 A1 Jun. 14, 2018

(30) Foreign Application Priority Data

Dec. 8, 2016 (DE) ..... 10 2016 014 585

(51) Int. Cl.
*F15B 15/08* (2006.01)
*E01C 19/26* (2006.01)
(Continued)

(52) U.S. Cl.
CPC ..... *E01C 19/266* (2013.01); *E01C 19/264* (2013.01); *E01C 19/282* (2013.01);
(Continued)

(58) Field of Classification Search
CPC ..... F15B 15/082
(Continued)

(56) References Cited

U.S. PATENT DOCUMENTS 2,648,310 A * 8/1953 Baer, Sr. ..... B64F 1/06 92/88
3,772,966 A 11/1973 Mills
(Continued)

FOREIGN PATENT DOCUMENTS

CN 101368362 A 2/2009
CN 102121490 A 7/2011
(Continued)

OTHER PUBLICATIONS

Ex. A, Photographs of prior art manual locking pin (3 pages) (undated but admitted to be prior art).
(Continued)

*Primary Examiner* — Gary S Hartmann
(74) *Attorney, Agent, or Firm* — Lucian Wayne Beavers; Patterson Intellectual Property Law, PC

(57) ABSTRACT

An actuating unit for locking a component of a construction machine, in particular a road milling machine or a surface miner, the actuating unit comprising a retaining part for fastening to the construction machine. A self-propelled construction machine, in particular a road milling machine or a surface miner, comprising at least one actuating unit of this type. The basic principle of the actuating unit is the design of the cylinder of a piston/cylinder arrangement as a "locking bolt". In the actuating unit, a piston is connected to the retaining part and is surrounded by a cylinder, with a first cylinder chamber being formed on one side of the piston and a second cylinder chamber being formed on the other side of the piston. A cut-out which extends in the direction of the longitudinal axis of the cylinder and through which the retaining part extends is provided in the cylindrical wall of the cylinder. If one of the two cylinder chambers is supplied with a fluid, the cylinder moves to one side or the other, while the retaining part remains stationary. Therefore, the
(Continued)

cylinder constitutes a "locking bolt", which can be pushed forward or pulled back.

24 Claims, 10 Drawing Sheets

(51) Int. Cl.
*E01C 19/28* (2006.01)
*E02F 3/76* (2006.01)
*E01C 23/088* (2006.01)

(52) U.S. Cl.
CPC ..... *E01C 19/286* (2013.01); *E01C 23/088* (2013.01); *E02F 3/764* (2013.01); *F15B 15/082* (2013.01)

(58) Field of Classification Search
USPC ..... 92/88; 299/95; 303/89; 37/455
See application file for complete search history.

(56) References Cited

U.S. PATENT DOCUMENTS

| | | | | |
|---|---|---|---|---|
| 3,820,446 | A * | 6/1974 | Granbom et al. | F01B 17/00 92/88 |
| 4,164,893 | A | 8/1979 | Granbom et al. | |
| 4,723,867 | A | 2/1988 | Wirtgen | |
| 4,819,546 | A * | 4/1989 | Ernst | F15B 15/082 92/5 R |
| 5,474,397 | A | 12/1995 | Lyons | |
| 5,606,903 | A * | 3/1997 | Drittel | F15B 15/082 277/345 |
| 6,832,541 | B2 * | 12/2004 | Satou | F15B 15/1471 92/88 |
| 7,587,971 | B2 * | 9/2009 | Kriegsmann | F02B 71/00 92/85 R |
| 8,100,480 | B2 | 1/2012 | Ktting et al. | |
| 8,376,469 | B2 * | 2/2013 | Kotting | E01C 23/088 299/39.6 |
| 8,899,690 | B2 * | 12/2014 | Kotting | E01C 23/088 299/1.5 |
| 9,175,448 | B2 * | 11/2015 | von Schoenebeck | E01C 23/088 |
| 9,551,118 | B2 * | 1/2017 | Kotting | E01C 23/088 |
| 9,644,340 | B1 * | 5/2017 | Kotting | E01C 23/088 |
| 9,714,488 | B2 | 7/2017 | Franzmann et al. | |
| 10,208,436 | B2 * | 2/2019 | Kotting | E01C 23/088 |
| 2013/0195554 | A1 * | 8/2013 | Rukavina | E01C 23/088 404/90 |
| 2016/0040371 | A1 | 2/2016 | Roetsch et al. | |
| 2017/0030033 | A1 | 2/2017 | Emme et al. | |
| 2018/0163351 | A1 | 6/2018 | Frankemölle et al. | |

FOREIGN PATENT DOCUMENTS

| | | | |
|---|---|---|---|
| CN | 203393585 | U | 1/2014 |
| CN | 208362872 | U | 1/2019 |
| DE | 2833533 | A1 | 2/1979 |
| DE | 3528038 | A1 | 2/1987 |
| DE | 44 22 528 | A1 * | 6/1994 |
| DE | 102007038677 | A1 | 2/2009 |
| DE | 102014011856 | A1 | 2/2016 |
| EP | 0685098 | A1 | 12/1995 |
| EP | 2636794 | A1 | 9/2013 |

OTHER PUBLICATIONS

Ex. B, Drawing 03.01.02/00—Drum Suspension (1900/2000 mm) (1 page) (undated but admitted to be prior art).
European Search Report for European Patent Application No. EP 17 20 6016, dated Mar. 16, 2018, 9 pages (not prior art).
China Search Report for corresponding CN 2017112941758, dated Dec. 8, 2017, 3 pages (not prior art).

* cited by examiner

ACTUATING UNIT FOR LOCKING A COMPONENT OF A CONSTRUCTION MACHINE

BACKGROUND OF THE INVENTION

1. Field of the Invention

The invention relates to an actuating unit for locking a component of a construction machine, in particular a road milling machine or a surface miner, the actuating unit comprising a retaining part for fastening the actuating unit to the construction machine. Furthermore, the invention relates to a self-propelled construction machine, in particular a road milling machine or a surface miner, comprising at least one actuating unit of this type.

2. Description of the Prior Art

Known construction machines have a plurality of assemblies, which each comprise a plurality of components. There is only limited space available on the construction machine for arranging all the components. Therefore, the basic aim is to arrange components of a construction machine close to one another.

Components that are movable relative to one another are also included in the assemblies of known construction machines. For certain tasks of the construction machine, it is often necessary for it to be possible for a movable component to be brought into engagement with another, immovable component, such that the movable component is locked. A wide range of locking devices are known for locking movable components. The use of a locking bolt, for example, allows simple and reliable locking. The locking bolt can be used manually. Locking devices are also known that have an actuating unit comprising a piston/cylinder arrangement in order to move the locking bolt. In these actuating units, the piston of the piston/cylinder arrangement is connected to the locking bolt in a linear arrangement such that the piston can actuate the locking bolt. This arrangement of the piston/cylinder arrangement and the locking bolt means that the actuating unit has relatively large dimensions in the longitudinal direction.

Known road milling machines or surface miners comprise a machine frame supported by running gears and a milling drum for machining the ground that is arranged in a milling drum housing, which is closed off by a scraper plate behind the milling drum in the working direction. In front of the milling drum in the working direction, the milling drum housing is closed off by a hold-down device. An edge protector may be provided on either side of the milling drum.

The scraper plate of known road milling machines or surface miners, which extends transversely to the working direction, can be moved in a substantially vertical plane between a lowered position in which the lower edge of the scraper plate rests on the ground or is arranged directly above the ground, and a raised position. The scraper plate can generally also be pivoted about a pivot axis that extends in parallel with the milling drum axis, such that the milling drum is accessible for inspection and maintenance purposes.

DE 35 28 038 A1 (U.S. Pat. No. 4,723,867 A) describes a road milling machine comprising a scraper plate, which is also referred to as a material collection flap. The scraper plate is actuated by a piston/cylinder arrangement in conjunction with a sliding block guide, which first allows a lifting movement of the scraper plate in a vertical plane, and then a pivoting movement. It is disadvantageous that the piston/cylinder arrangement, which is intended to allow not only a lifting movement but also a pivoting movement of the scraper plate, has a relatively long overall length in order to be able to carry out the two movements one after the other.

EP 0 685 598 A1 (U.S. Pat. No. 5,474,397 A) describes a road milling machine comprising a scraper plate actuated by an actuating device that has a plurality of piston/cylinder arrangements. The scraper plate is locked for the transition of the lifting movement into the pivoting movement. Locking devices are provided for this purpose that comprise a locking bolt that is longitudinally movably guided in a cylindrical bore in a housing. To actuate the locking bolt, a pin is provided which is connected to the locking bolt. The piston/cylinder arrangements also have a relatively long overall length in this milling machine in order to be able to carry out the lifting and pivoting movements one after the other. Furthermore, it is no longer practical to manually actuate the pin in larger machines in order to lock and unlock the scraper plate, since excessively large forces would be required to adjust the pin, with corresponding dimensioning of the components.

A road milling machine in which the scraper plate is formed in two parts is known from U.S. Pat. No. 8,100,480 B2 (DE 10 2007 038 677 A1). The two-part scraper plate comprises an upper and a lower scraper element, the upper scraper element being stationary and the lower scraper element being height-adjustable in the operating position. The upper and the lower scraper element can also be pivoted together. A function of this type requires one of the two scraper elements to be locked, which is carried out by means of sliding blocks that are guided in a sliding block guide. The scraper plate can only move in a pivoting manner if the sliding blocks are not in engagement with the sliding block guide. The lower and the upper scraper element again move by means of piston/cylinder arrangements that have a comparatively long overall length.

In road milling machines or surface miners, there is intended to be as large a gap as possible in the scraper plate transversely to the working direction between the guides of the scraper plate or the piston/cylinder arrangements for a possible material outlet. The guides or piston/cylinder arrangements of the scraper plate are also intended to be as far apart from one another as possible, in order to prevent the scraper plate from tilting when being raised or lowered. This arrangement means that there is only a comparatively small amount of space between the side parts of the milling drum housing and the guides or piston/cylinder arrangements.

SUMMARY OF THE INVENTION

One object of the invention is to provide a universally applicable actuating unit for locking a component of a construction machine, in particular a road milling machine or a surface miner, which allows simple and reliable locking of a component of the construction machine and can also be installed between other components of the construction machine even if space is limited.

Another object of the invention is to provide a self-propelled construction machine, in particular a road milling machine or surface miner, comprising a two-part scraper plate that allows reliably functioning height adjustment. The object of the invention is in particular that of solving the problem of locking one of the two scraper elements even if space is limited.

These objects are achieved according to the invention by the features of the claims.

The basic principle of the actuating unit according to the invention is the design of the cylinder of a piston/cylinder arrangement as a "locking bolt".

The actuating unit according to the invention for locking a component of a construction machine, in particular a road milling machine or a surface miner, comprises a retaining part for fastening to the construction machine. The retaining part may be formed in various ways. The only important aspect of the retaining part is that secure fastening to a component of the construction machine is ensured. The retaining part may also consist of a plurality of individual parts. The fastening of the retaining part to a component of the construction machine only needs to secure the position of the actuating unit, i.e. does not need to absorb any larger forces or torques, in particular not the forces or torques that may arise by the component being locked.

In the actuating unit according to the invention, a piston is connected to the retaining part and is surrounded by a cylinder, with a first cylinder chamber being formed on one side of the piston and a second cylinder chamber being formed on the other side of the piston. The piston may be an integral component of the retaining part. The retaining part, piston or cylinder may also each consist of a plurality of individual parts.

A preferred embodiment provides that the retaining part comprises an elongate body or is designed as an elongate body, the longitudinal axis of which extends perpendicularly to the longitudinal axis of the cylinder. In a particularly preferred embodiment, the retaining part is a rod, in particular a cylindrical rod, which can be securely fastened to a suitable mount, which may be provided on a component of the construction machine. For example, the rod can be fixed in the mount in a clamped manner. However, it is also possible for the rod to be welded to a component of the construction machine. Fastening by interlocking is also possible.

By contrast with a conventional piston/cylinder arrangement, in the actuating unit according to the invention, the "piston" is not a component that is movable in a stationary cylinder, because it is not the cylinder but the piston that is connected to a stationary component on the construction machine by means of the retaining part.

The cylinder forms, together with the piston, a first cylinder chamber on one side of the piston, and a second cylinder chamber on the other side of the piston, a first fluid connection being in fluid communication with the first cylinder chamber and a second fluid connection being in fluid communication with the second cylinder chamber. A cut-out which extends in the direction of the longitudinal axis of the cylinder and through which the retaining part extends is provided in the cylindrical wall of the cylinder. The retaining part can be guided in the cut-out extending in the longitudinal direction such that the cylinder cannot twist relative to the retaining part.

If one of the two cylinder chambers is supplied with a fluid, for example hydraulic liquid or compressed air, the cylinder moves to one side or the other, while the retaining part remains stationary. Therefore, the cylinder constitutes a "locking bolt", which can be pushed forward or pulled back. The means for actuating the "locking bolt" are effectively a component of the bolt.

Since the actuating unit is a "piston/cylinder arrangement" in the broad sense, the relevant components are referred to as a piston and a cylinder. However, the "piston" connected to the stationary retaining part does not move and the "cylinder" does move relative to the stationary retaining part. A cylinder is also understood to be a body that does comprise a cylindrical bore for the piston, but does not have a peripheral surface that is cylindrical over its entire length. It is however advantageous for the cylinder to be designed as a cylindrical securing bolt.

Since the cylinder has a relatively large outer diameter in comparison with the piston, the "locking bolt" can absorb relatively large forces. The wall thickness of the cylinder can be accordingly dimensioned.

The fluid connections may in principle be provided on the cylinder or the piston. It is however advantageous for the first and the second fluid connection to be provided on the piston, with the first and the second fluid connection extending through the cut-out in the cylindrical wall of the cylinder, since the connections then do not move during locking and unlocking. Furthermore, this arrangement provides a particularly compact design. The known connections for fluid lines, in particular hydraulic lines or compressed air lines, can be used as fluid connections to which hydraulic lines or compressed air lines can be connected.

A preferred embodiment provides that the first fluid connection is arranged on the piston on one side of the retaining part and the second fluid connection is arranged on the piston on the other side of the retaining part, a first fluid channel leading from the first fluid connection to the first cylinder chamber being formed on one side of the retaining part in the piston and a second fluid channel leading from the second fluid connection to the second cylinder chamber being formed on the other side of the retaining part in the piston. This results in a symmetrical arrangement in which the fluid can be supplied centrally.

In another preferred embodiment, the cylinder has an outer cylinder part and at least one inner cylinder part that is inserted into the outer cylinder part on one side, and at least one inner cylinder part that is inserted into the outer cylinder part on the other side. In this embodiment, the cut-out for the retaining part is provided in the cylindrical wall of the outer cylinder part between the at least one inner cylinder part on one side of the outer cylinder part and the at least one inner cylinder part on the other side of the outer cylinder part. Here, one end part of the piston can be guided in the at least one inner cylinder part on one side of the outer cylinder part and the other end part of the piston can be guided in the at least one inner cylinder part on the other side of the outer cylinder part. The central portion of the piston can be guided in the outer cylinder part. The use of inserts provides advantages in terms of manufacturing in that the inserts can be machined more easily. For example, the inserts can be easily provided with grooves for seal packages without any great manufacturing complexity.

The actuating unit according to the invention can be used universally. A particularly preferred use of the actuating unit is the use in a self-propelled construction machine, in particular a road milling machine or a surface miner.

The construction machine may have one or more of the actuating units according to the invention, it being possible for an actuating unit to be assigned to any two components in each case that are interconnected so as to be movable relative to one another, in order to bring the two components into engagement. If one of the two components is movable and the other is immovable, i.e. stationary, the movable part can be locked.

In a preferred embodiment of the construction machine, a cut-out for receiving the cylinder of the actuating unit is provided on one of the two movably interconnected components, the retaining part of the actuating unit being fastened to the other component such that the cylinder is pushed forward into the cut-out when the first or second cylinder chamber is supplied with a fluid such that the two components are in engagement. The cylinder is pulled back out of the cut-out when the second or first cylinder chamber is supplied with a fluid such that the two components are out of engagement.

A mount for fastening the retaining part is preferably provided on the component of the construction machine to which the retaining part of the actuating unit is intended to be fastened, such that assembly is simplified. The retaining part may however also be screwed in, inserted (interlocked) or welded in, for example. The retaining part may be fastened by clamped attachment.

Another preferred embodiment provides that at least one support part comprising a cut-out in which the cylinder can be slid or into which the cylinder can be slid is provided on the component of the construction machine to which the retaining part is intended to be fastened. This means that the forces or torques arising during locking are not absorbed solely by the retaining part or the mount thereof, but are substantially absorbed by the "locking bolt". Preferably, the cylinder is movably guided in the cut-out in the at least one support part, such that forces or torques are absorbed by the at least one support part both in the locked and the unlocked position. The at least one support part thus not only can absorb the forces or torques arising during locking, but can also absorb the weight force of the actuating unit. The retaining part itself or the mount thereof can therefore be accordingly easily dimensioned. Said retaining part is then used only for securing in position.

The advantages of the actuating unit according to the invention come into effect in particular when locking one of the two scraper elements of a two-part scraper plate of a construction machine, in particular a milling machine or a surface miner. The construction machine according to the invention comprising the actuating unit is characterised in that the scraper plate can be operated simply and reliably. This means that the actuating unit can be easily mounted even if space is limited.

The scraper plate of the construction machine according to the invention has an upper scraper element that is fastened to a component of the machine frame or milling drum housing so as to be pivotable about a pivot axis that is parallel to the milling drum axis, and a lower scraper element that is movable relative to the upper scraper element between a position in which it is lowered onto the ground and a raised position.

The construction machine may comprise one or more of the actuating units according to the invention. The cut-out for receiving the cylinder of the at least one actuating unit is provided on a component of the machine frame or milling drum housing, and the retaining part of the actuating unit is fastened to the upper scraper element such that the cylinder is pushed forward into the cut-out when the first or second cylinder chamber is supplied with a fluid such that the upper scraper element is locked, and the cylinder is pulled back out of the cut-out when the second or first cylinder chamber is supplied with a fluid such that the upper scraper element is unlocked.

For actuating the scraper plate, an actuating device is provided which is designed such that, when the upper scraper element is locked, the lower scraper element can be moved between the lowered and the raised position and, when the upper scraper element is unlocked, the lower and the upper scraper element can be pivoted about the pivot axis out of the operating position into a raised position.

The actuating device for the scraper plate may have a plurality of piston/cylinder arrangements. In a preferred embodiment, the actuating device has a first piston/cylinder arrangement and a second piston/cylinder arrangement, which are arranged on the scraper plate at a distance from one another. A first actuating unit is arranged in a region between the first piston/cylinder arrangement and a side part of the machine frame or milling drum housing and a second actuating unit is arranged in a region between the second piston/cylinder arrangement and a side part of the machine frame. The cut-out for receiving the cylinder of the actuating unit is provided in the side part of the machine frame or milling drum housing.

The kinematics is designed such that the two-part scraper plate can be both raised and pivoted using just one pair of piston/cylinder arrangements. However, just one piston/cylinder arrangement can be provided instead of two piston/cylinder arrangements, or more than two piston/cylinder arrangements can be provided, in order to carry out the two movements. However, it is also possible to carry out the raising and pivoting movements separately from one another, using one or more piston/cylinder arrangements in each case.

Another preferred embodiment provides that the cylinders of the first and second piston/cylinder arrangement can be pivoted about an axis extending in parallel with the pivot axis of the scraper plate on a component of the machine frame or milling drum housing, and the pistons or piston rods of the first and second piston/cylinder arrangement are fastened in the region of the lower portion of the lower scraper element. Preferably, the first and the second actuating units are arranged in the region of the lower portion of the upper scraper element.

BRIEF DESCRIPTION OF THE DRAWINGS

An embodiment of the invention is explained in more detail below with reference to the drawings, in which.

DETAILED DESCRIPTION

Figure 1:
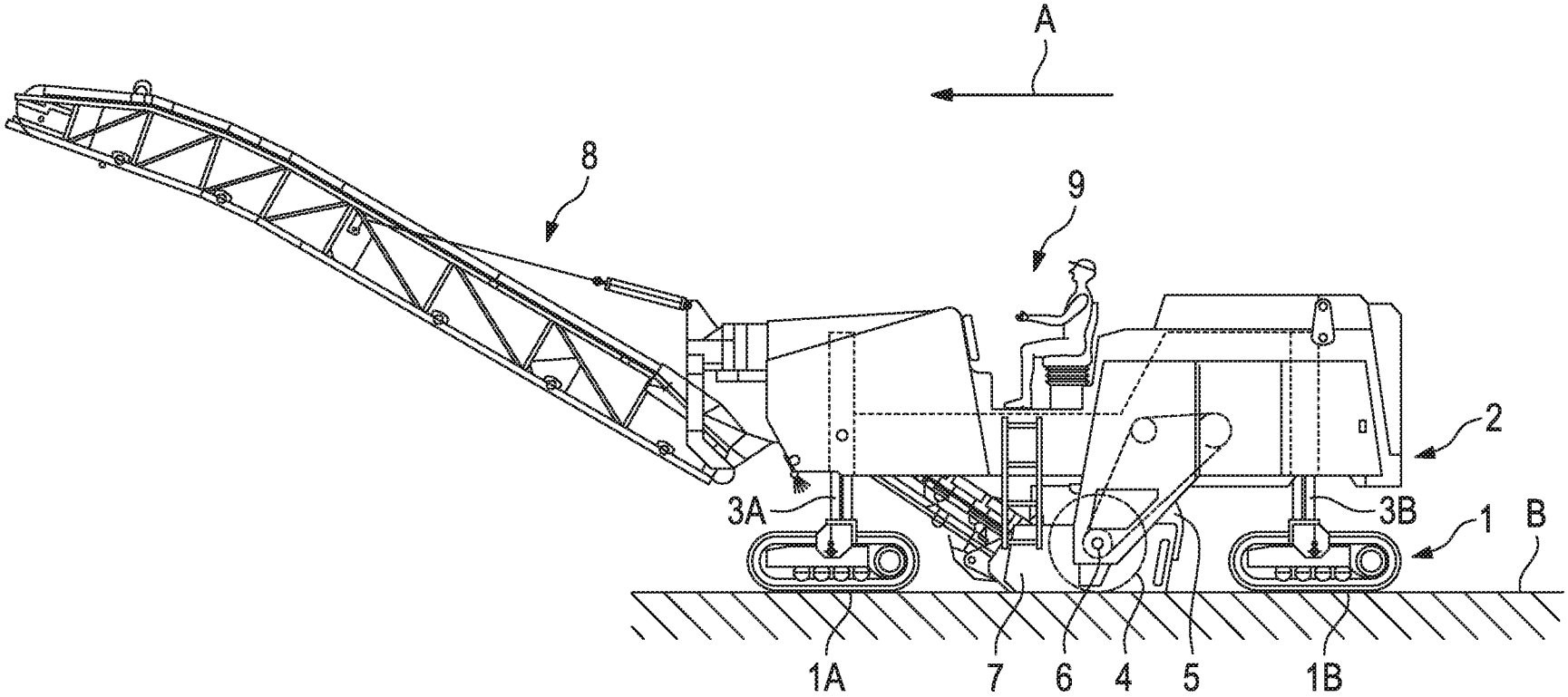
FIG. 1 is a side view of a road milling machine as an example of a self-propelled construction machine.

FIG. 1 shows a road milling machine for milling off asphalt, concrete or similar road surfaces as an example of a self-propelled construction machine. The road milling machine comprises a machine frame 2 supported by a chassis 1. The chassis 1 comprises front and rear running gears 1A, 1B, which are arranged on the right and left side of the machine frame 2 in the working direction A. The running gears 1A, 1B are fastened to lifting columns 3A, 3B which are attached to the machine frame 2, in such a way that the machine frame 2 is height-adjustable with respect to the ground B.

The road milling machine has a milling drum 4, which is equipped with milling tools (not shown). The milling drum 4 is arranged on the machine frame 2 between the front and rear running gears 1A, 1B in a milling drum housing 5. The axis of rotation 6 of the milling drum 4 extends transversely to the working direction A of the milling machine. The milling drum housing 5 is closed off at the front face in the working direction A by a hold-down device (not shown in FIG. 1) and at the rear face by a scraper plate (not shown in FIG. 1), which is also referred to as a scraper. At the longitudinal faces, the drum housing is closed off by an edge protector 7. The milled material which is milled off can be transported away by a transport device 8. The driver's platform 9 is located on the machine frame 2, above the milling drum housing 5.

In the following, the two-part scraper plate and the actuating device for the scraper plate of the construction machine according to the invention are described with reference to FIGS. 2 to 8, which show the scraper plate 10 together with the actuating device, as well as parts of the milling drum housing 2 and the milling drum 4. The edge protector 7 is not shown in FIGS. 2 to 8.

The scraper plate 10 comprises a lower scraper element 11 and an upper scraper element 12, the lower scraper element 11 being arranged in front of the upper scraper element 12 in the working direction A. The two scraper elements 11, 12 are substantially rectangular plates. The upper scraper element 12 is fastened to a component of the milling drum housing 5 so as to be pivotable about a pivot axis 13 that extends in parallel with the axis of rotation 6 of the milling drum 4. The lower scraper element 11 comprises two guide elements 14 that are arranged so as to be at a distance from one another, which are guided in two guides 15 of the upper scraper element 12 that are arranged so as to be at a distance from one another, such that the lower scraper element 11 can be moved relative to the upper scraper element 12.

The actuating device 16 for actuating the scraper plate 10 comprises a pair of piston/cylinder arrangements 17 that are arranged so as to be at a distance from one another. Actuating device 16 may also be referred to as a scraper plate actuating assembly 16. The first piston/cylinder arrangement 17 is arranged on one side of the scraper plate 10 and the second piston/cylinder arrangement 17 is arranged on the other side of said scraper plate, at a distance from the relevant edge of the scraper plate. The cylinders of the piston/cylinder arrangements 17 are fastened to mounts 20 of the milling drum housing 5 so as to be pivotable about a pivot axis 21 that extends in parallel with the axis of rotation 6 of the milling drum 4 and with the pivot axis 13 of the scraper plate 10. Pivot axis 21 may also be referred to as a connection axis 21. The pistons or piston rods 19 of the piston/cylinder arrangements 17 are fastened to mounts 22 of the lower scraper element 11 so as to be pivotable about a pivot axis 23 that extends in parallel with the pivot axis 21 of the piston/cylinder arrangements 17. The upper scraper element 12 can be locked to side parts 24 of the milling drum housing 5. To lock the upper scraper element 12, the actuating device 16 comprises two locking devices 25 which each have an actuating unit according to the invention. The locking devices 25 are arranged between the piston/cylinder arrangements 17 and the side parts 24 of the drum housing 5.

Figure 9:
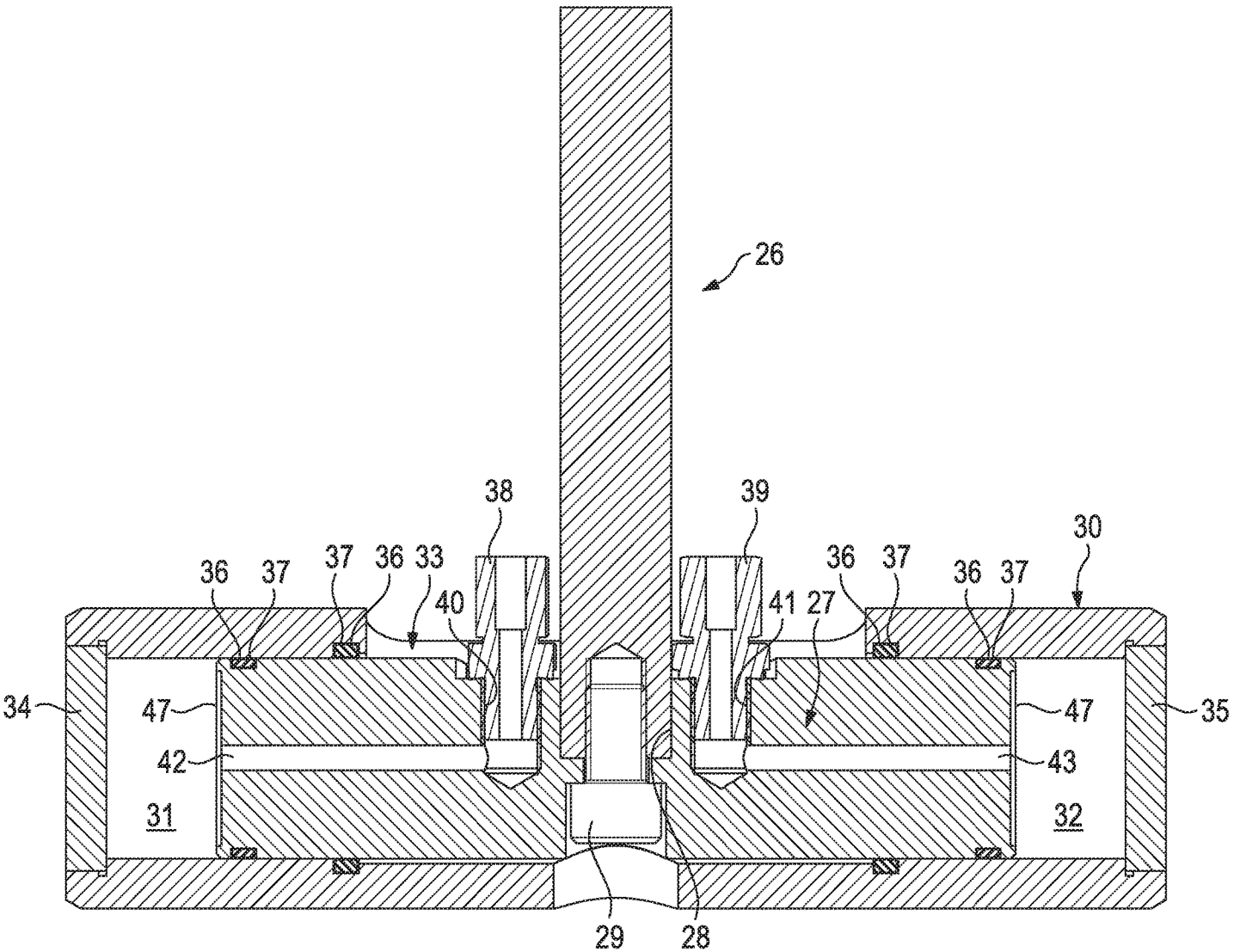
FIG. 9 shows a first embodiment of the actuating unit according to the invention.

FIG. 9 shows a first embodiment of the actuating unit of the locking devices 25. The actuating unit may be referred to as a lock actuating unit. The actuating unit comprises a retaining part 26, which is a cylindrical bar in the present embodiment. The retaining part 26 is connected to a piston 27, the longitudinal axis of the retaining part 26 and the longitudinal axis of the piston 27 enclosing a right angle. For this purpose, one end part of the retaining part 26 is inserted into a cut-out 28 in the piston 27 and the retaining part 26 is screwed to the piston 27 by means of a screw 29. The cut-out 28 in the piston 27 is positioned in the center, between the ends of the piston. The piston is surrounded by a cylinder 30, with a first cylinder chamber 31 being formed on one side of the piston and a second cylinder chamber 32 being formed on the other side of the piston. Here, the retaining part 26 extends through a cut-out 33 in the cylindrical wall of the cylinder, the cut-out 33 extending in the longitudinal direction of the cylinder 30. The width of the cut-out 33 corresponds to the diameter of the retaining part 26, such that the retaining part 26 and the cylinder 30 cannot be twisted relative to one another. The cylinder 30 is closed off at either end by caps 34, 35, which can be screwed on. The piston 27 and the cylinder 30 are sealed by means of known seal packages 36, which are generally positioned in annular grooves 37 on the piston 27 and cylinder 30.

Fluid connections 38, 39, which are inserted into cut-outs 40, 41 in the piston 27, are positioned on the piston 27 on either side of the retaining part 26. In the present embodiment, the fluid connections 38, 39 are conventional connections for hydraulic lines (not shown). A first fluid channel 42 leads from the first fluid connection 38 to one end of the piston, and a second fluid channel 43 leads from the second fluid connection 39 to the other end of the piston, such that the first and second cylinder chamber 31, 32 can be supplied with hydraulic fluid.

The retaining part 26 of the actuating unit is fastened to a mount 44, which is provided on the lower portion of the upper scraper element 12 between the piston/cylinder arrangement 17 and the side wall 24. The mount 44 comprises a bore 45, into which the retaining part 26 is inserted. The retaining part can be clamped by means of a locking screw 46 (FIGS. 2 to 8).

If the first cylinder chamber 31 is supplied with hydraulic fluid, the cylinder 30 moves to one side, while the cylinder 30 moves to the other side if the second cylinder chamber 32 is supplied with hydraulic fluid. Bevels 47 are provided on the end walls of the piston 27 such that the end face of the piston can act on the hydraulic fluid when the cylinder is in one of the two end positions. The cylinder 30 therefore constitutes a "securing bolt", which can be pushed forward and pulled back.

The two ends of the cylinder 30 are movably guided in cut-outs 49 by support parts 50 that are fastened to the lower end of the upper scraper element 12 at a distance from one another. The cut-outs 49 of support parts 50 may be referred to as support openings 49. In the position in which it is pushed forward, one end of the cylinder 30 engages in a cut-out 48 provided in the side wall 24 of the milling drum housing 5, the ends being positioned in the cut-outs 49 in the two support parts 50. The cut-out 48 in the side wall 24 may be referred to as a locking receptacle 48. In the pulled-back position, one end is not in the cut-out 48 in the side wall 24, but is only in the cut-out 49 in the support part 50. Therefore, the upper scraper element 12 can be brought into and out of engagement with the side part 24, i.e. can be locked or unlocked. The forces or torques that may arise due to locking are absorbed by the support parts 50. In the following, the function of the scraper plate 10 and the actuating device 16 is described in detail.

The pistons or piston rods 19 and the cylinders 18 of the piston/cylinder arrangements 17 are designed such that and the pivot axes 21, 23 thereof are arranged such that actuation of the piston/cylinder arrangements 17 results in the following movements of the scraper elements 11, 12.

Figure 2:
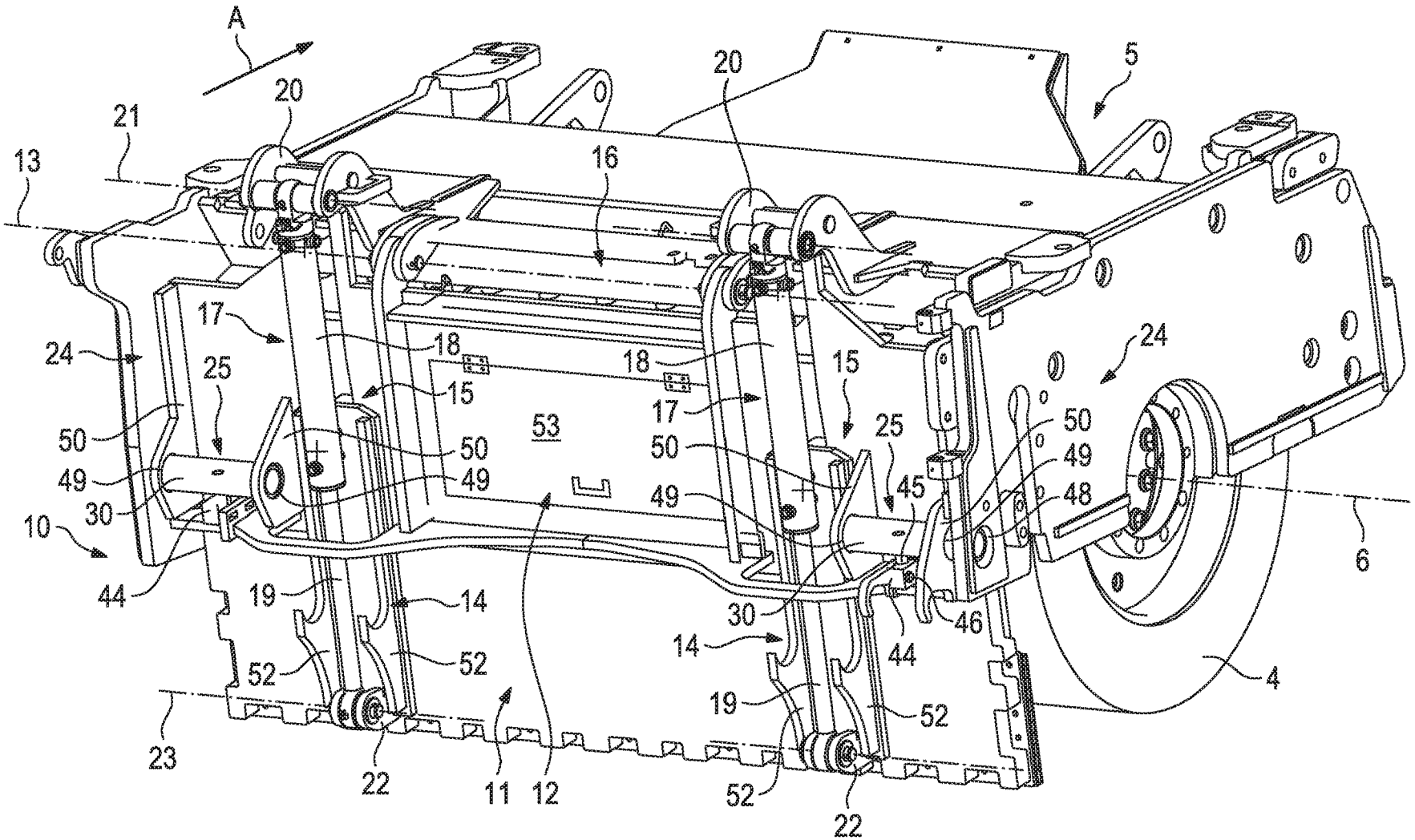
FIG. 2 is a perspective view of a two-part scraper plate of a construction machine together with an actuating device for the scraper plate as well as parts of the milling drum housing and the milling drum, the lower scraper element being in a lowered position.
Figure 3:
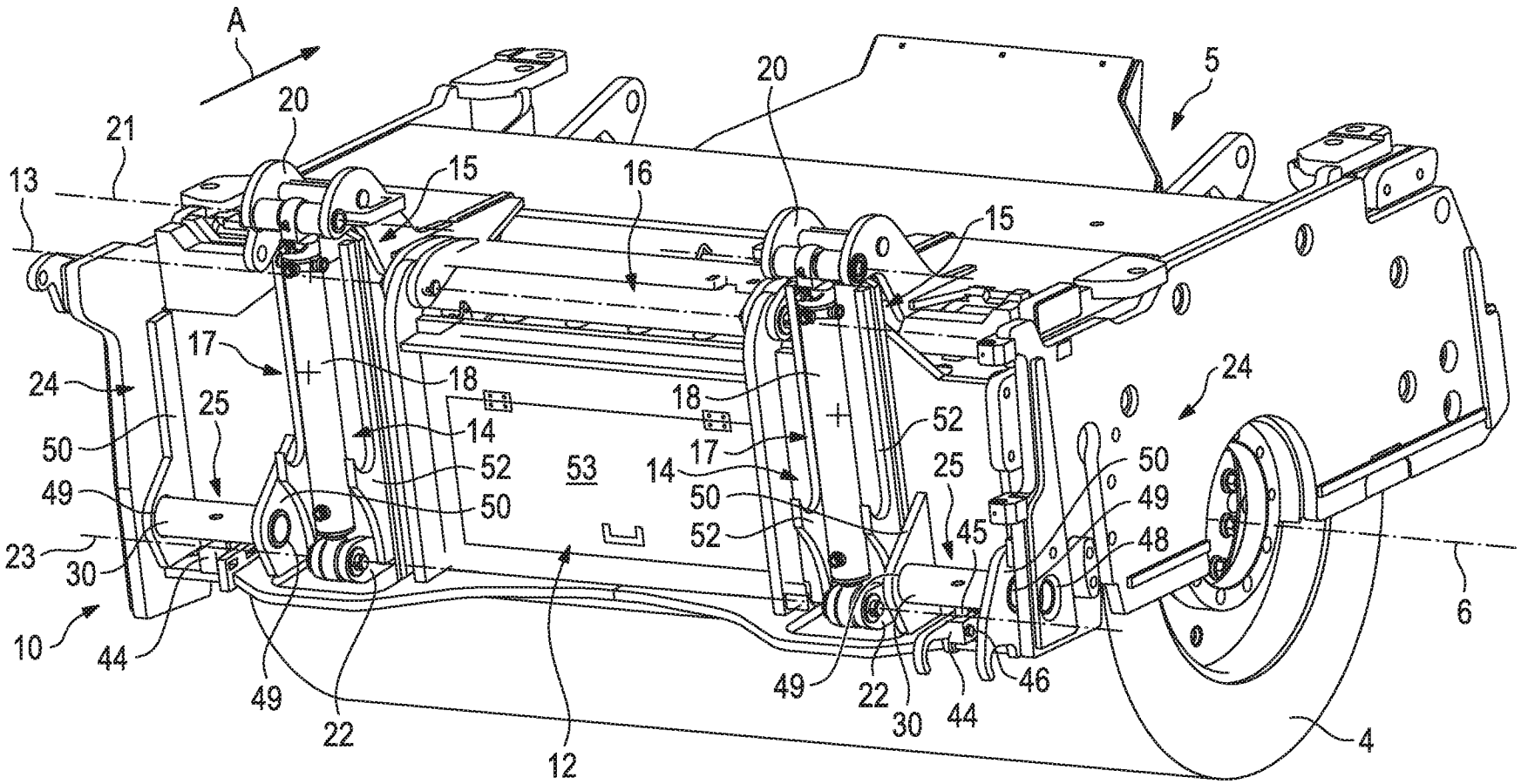
FIG. 3 shows the scraper plate from FIG. 2, the lower scraper element being in a raised position.

FIG. 2 shows the scraper plate 10 in a substantially vertical position, such that the milling drum housing 5 is closed off in the working direction A behind the milling drum 4. The lower scraper element 11 is in the lowered position in which the pistons or piston rods 19 of the piston/cylinder arrangements 17 are extended and the upper scraper element 12 is locked, i.e. the cylinder 30 is positioned in the cut-out 48. In this locked position, the lower scraper element 11 can be raised. To raise the lower scraper element 11, the pistons or piston rods 19 of the piston/cylinder arrangement 17 are retracted. FIG. 3 shows the lower scraper element 11 in the raised position, in which the piston/cylinder arrangements 17 are fully retracted. Therefore, the milling drum housing 5 is open below the upper scraper element 12.

A closable material outlet 53, for example a flap, may be provided in the upper scraper element 12 between the piston/cylinder arrangements 17. Therefore, the piston/cylinder arrangements 17 should be arranged at as great a distance as possible from one another, so that as large as possible a material outlet can be formed. This results in limited space in the region of either side of the scraper plate 10. It is clear that reliable locking is possible using the actuating units according to the invention, despite the limited space.

Figure 4:
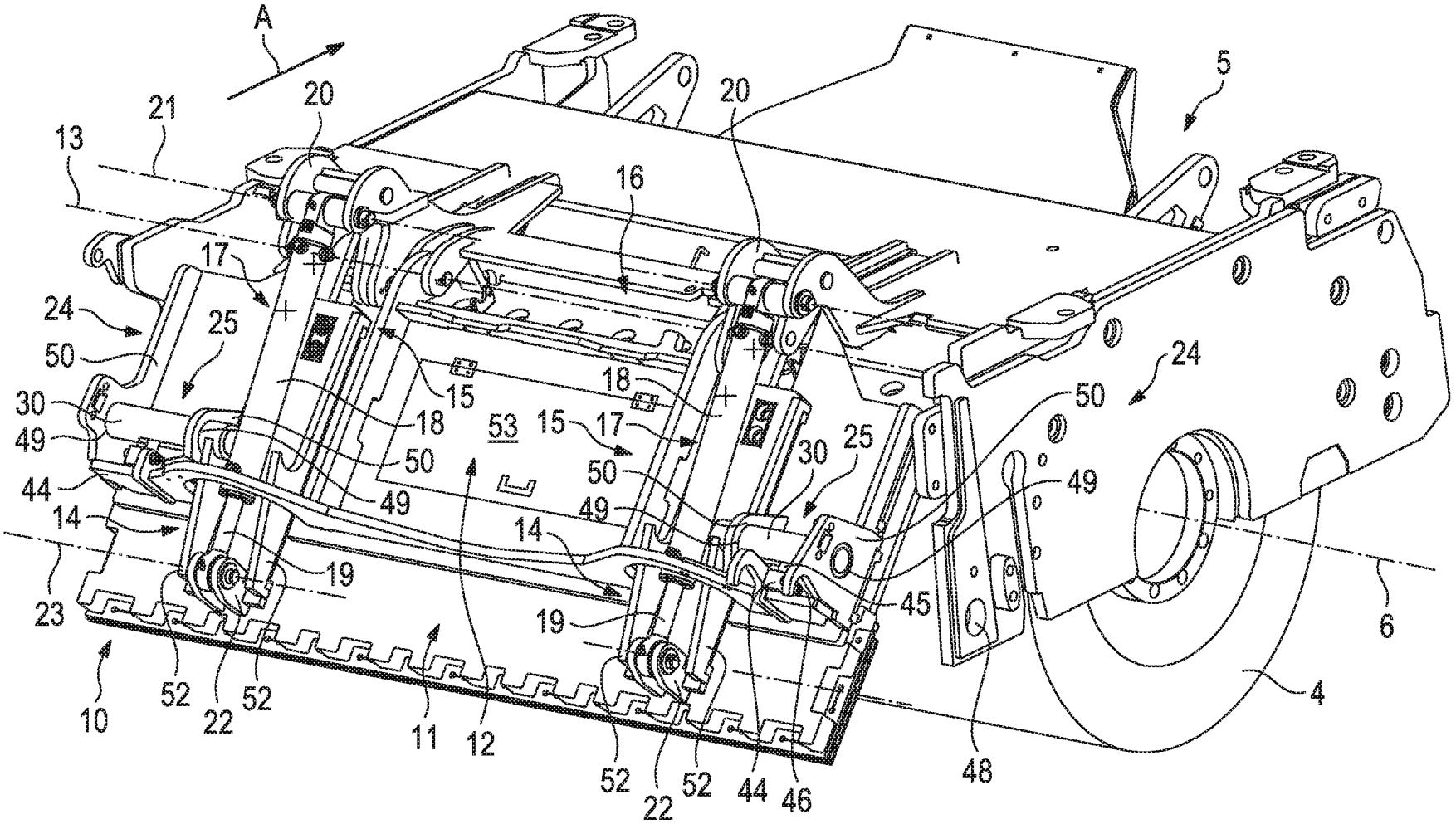
FIG. 4 shows the scraper plate from FIG. 2, the lower and the upper scraper element being in a lower pivot position.
Figure 5:
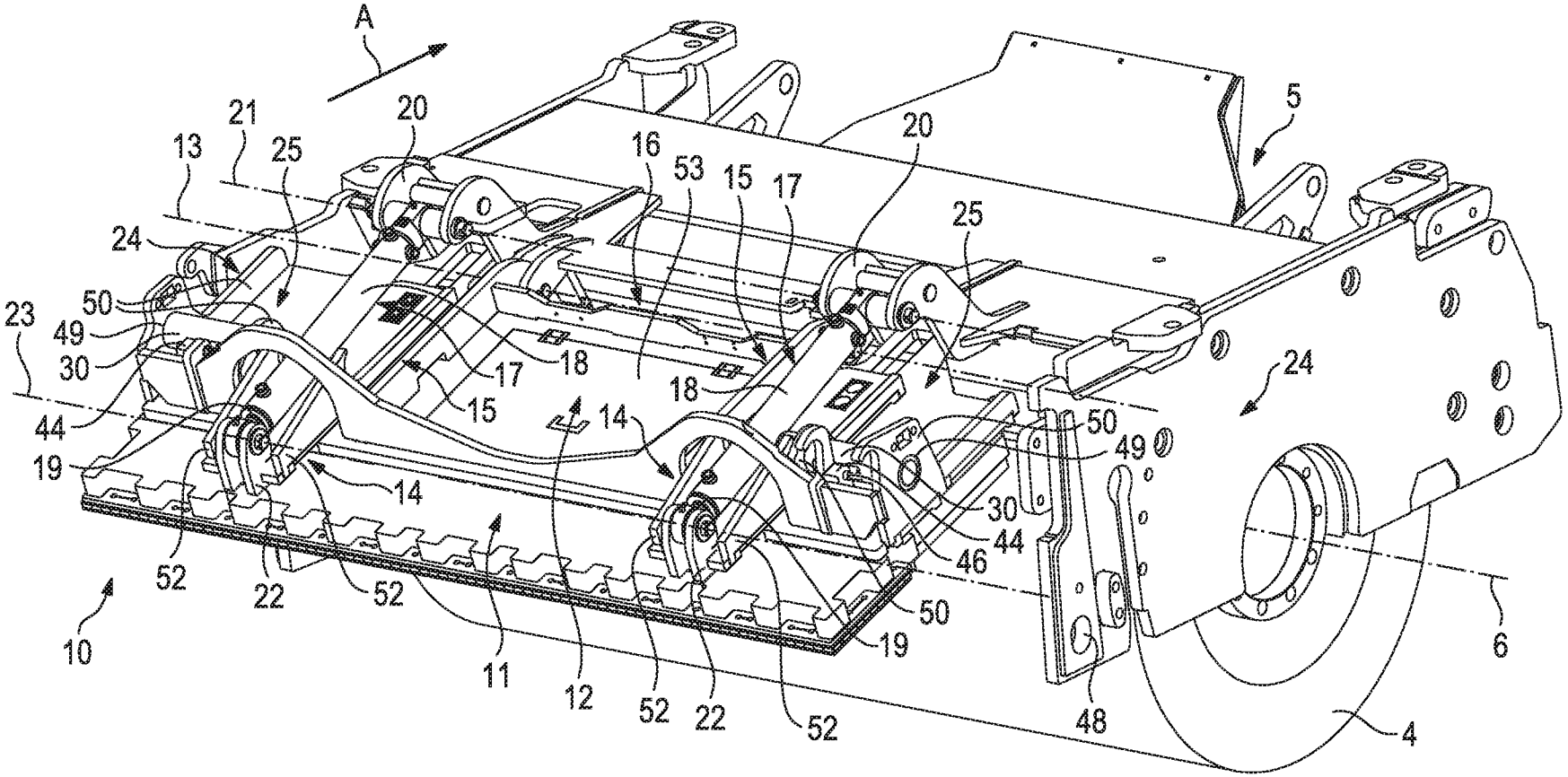
FIG. 5 shows the scraper plate from FIG. 2, the lower and the upper scraper element being in an upper pivot position.
Figure 6:
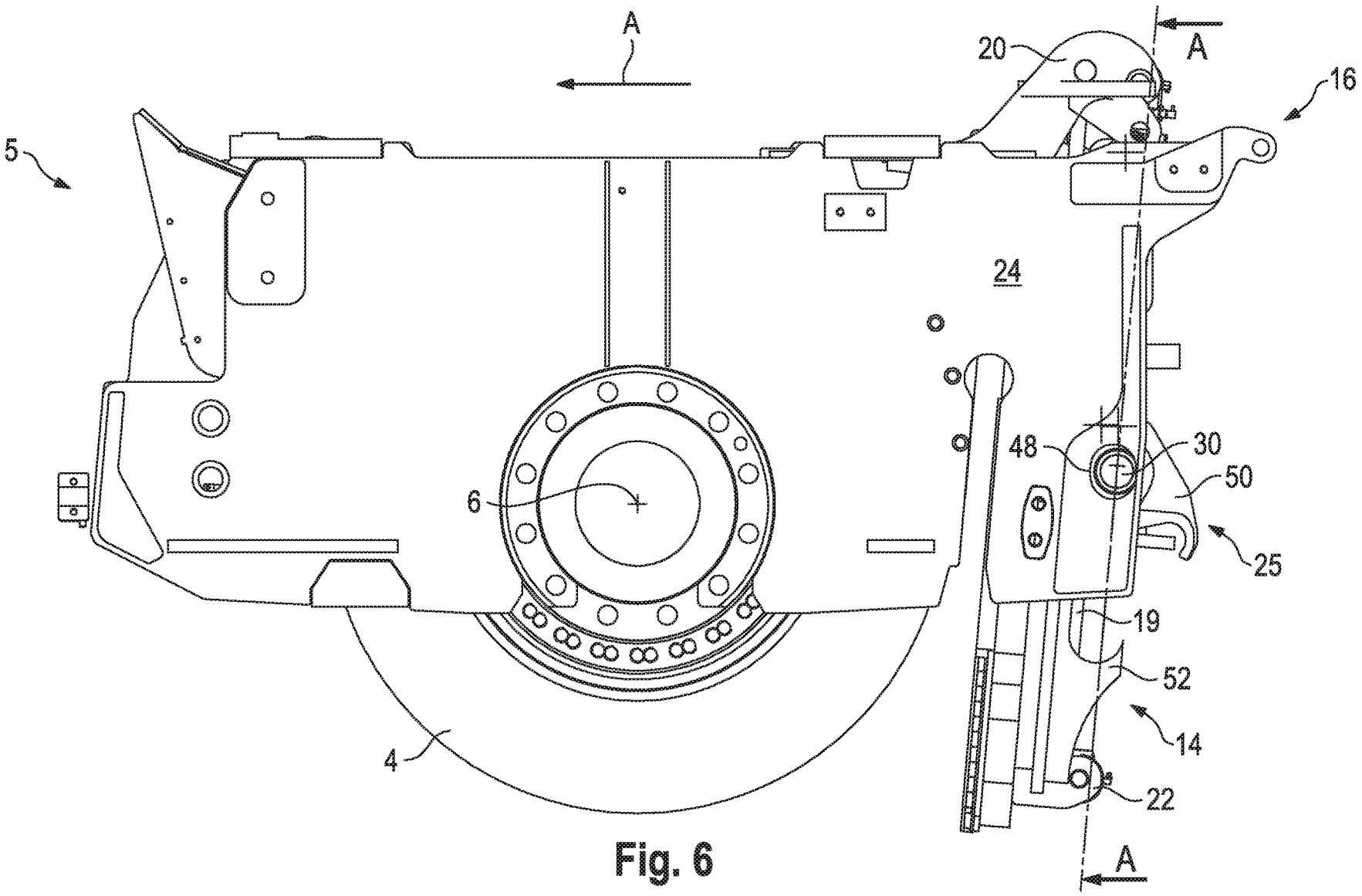
FIG. 6 is a side view of the scraper plate together with the actuating device and parts of the milling drum housing.
Figure 7:
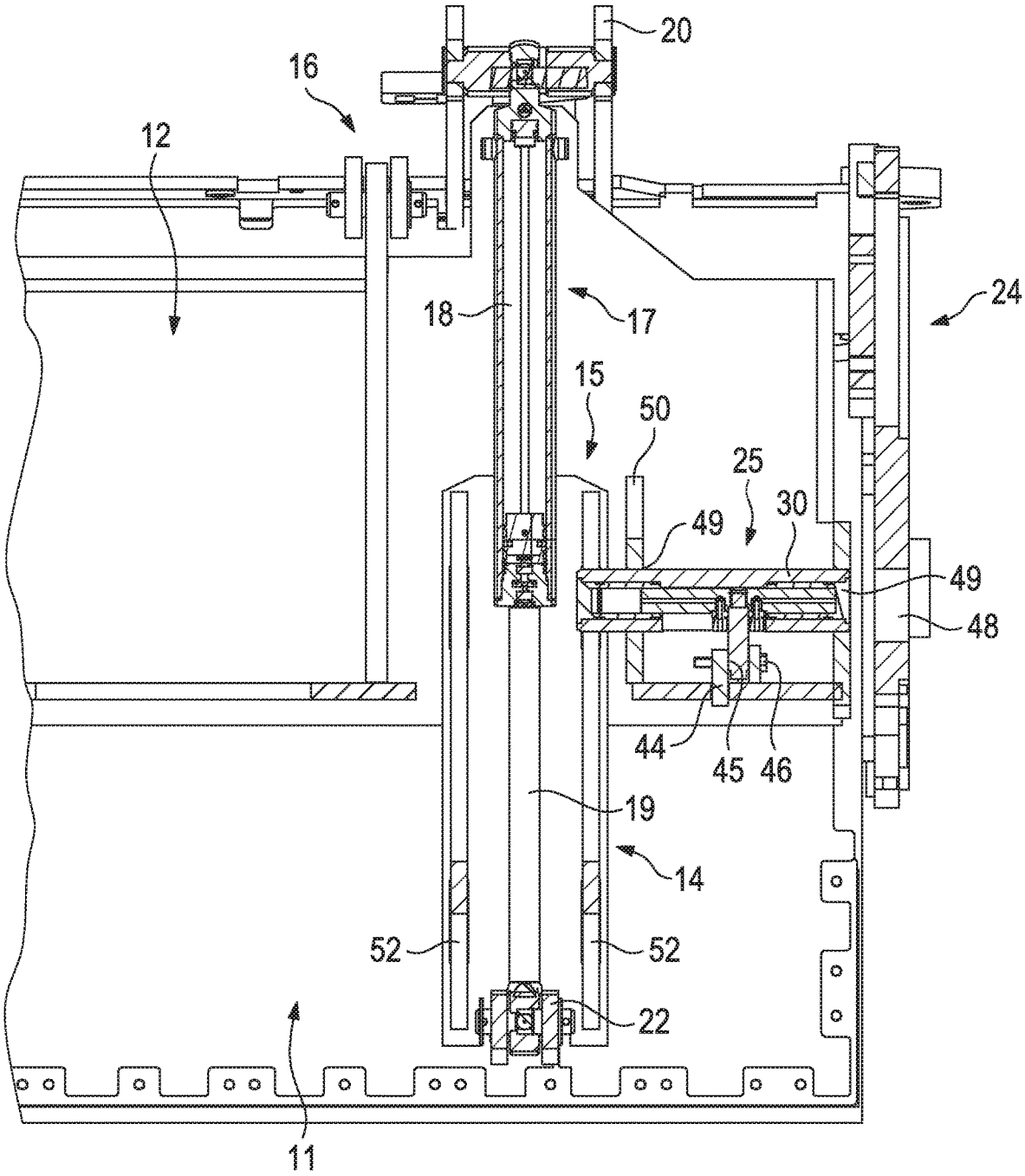
FIG. 7 is a partial section along the line A-A from FIG. 6.
Figure 8:
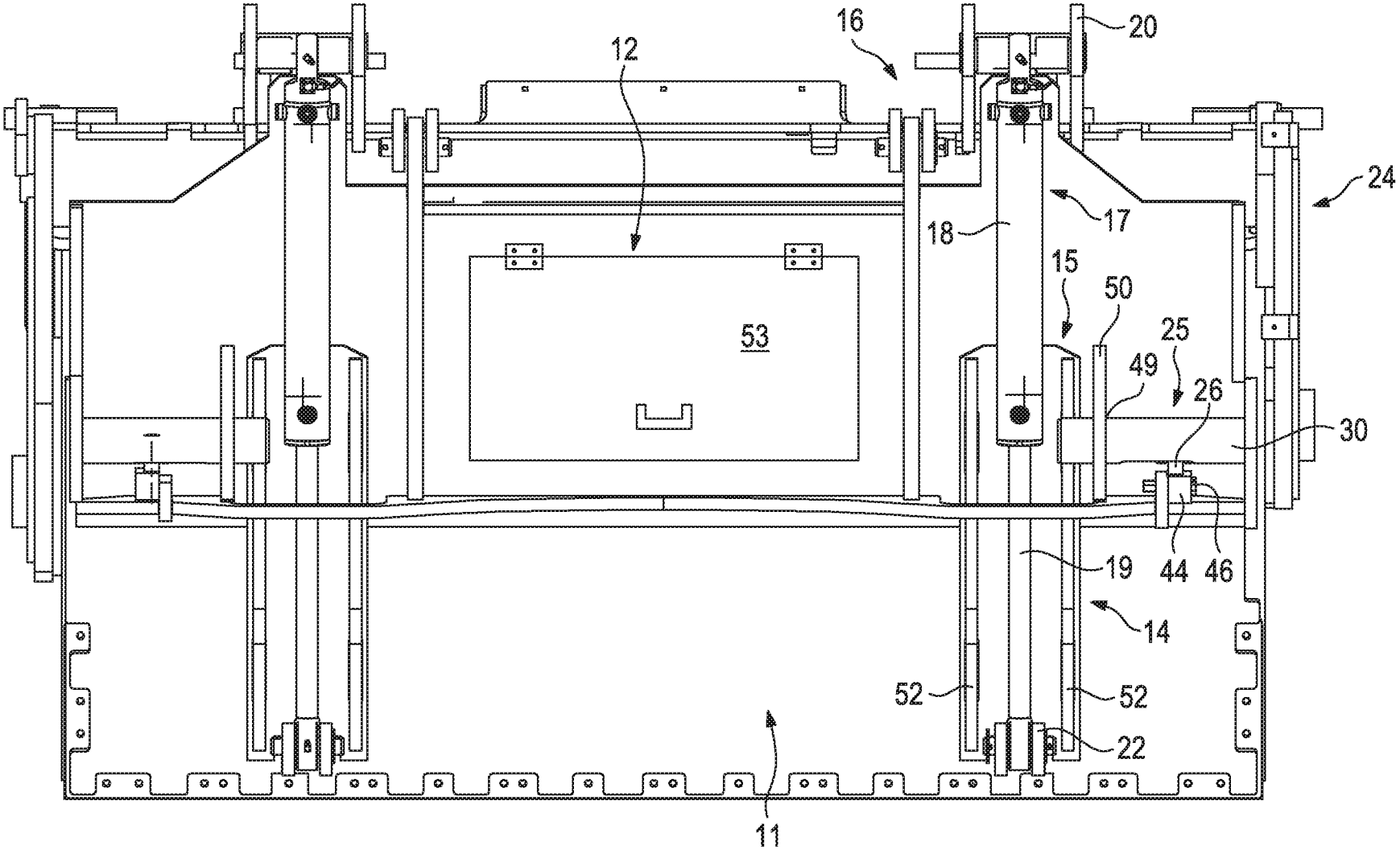
FIG. 8 is a plan view of the scraper plate from FIG. 6.

FIGS. 4 and 5 show how the scraper plate is folded upwards about the pivot axis 13. Entraining elements 52 assigned to the two actuating units are fastened to the lower scraper element 11, and can come into engagement with the cylinders 30 of the actuating units when the upper scraper element 12 is unlocked and the cylinders 30 are pulled back. In this position, the ends of the cylinders 30 project slightly out of the cut-outs 49 in the inner support parts 50, such that the entraining elements 52 can come into contact with the cylinders 30 during the upward movement of the lower scraper element 11.

The upper scraper element 12 is unlocked in order to fold the scraper plate 10 upwards. When the upper scraper element 12 is unlocked, actuation of the piston/cylinder arrangements 17 results in a pivoting movement of the scraper plate 10 about the pivot axis 13. This pivoting movement begins when the entraining elements 52 come into engagement with the protruding ends of the cylinders 30 of the actuating units during the upward movement of the lower scraper element 11. FIG. 5 shows the position of the scraper element 10 in which the piston/cylinder arrangements 17 are fully retracted, such that the scraper plate is folded completely upwards. The entraining elements 52 are arranged on the lower scraper element such that the pivoting movement begins even when the lower scraper element is not yet in the highest position (FIG. 3). Therefore, the pivoting movement begins right from a height position in which the vertical upward movement of the lower scraper element 11 has not yet been completed. Therefore, the piston/cylinder arrangements 17 can have a shorter overall length than if the pivoting movement is only carried out when the lower scraper element 11 is completely raised.

Figure 10:
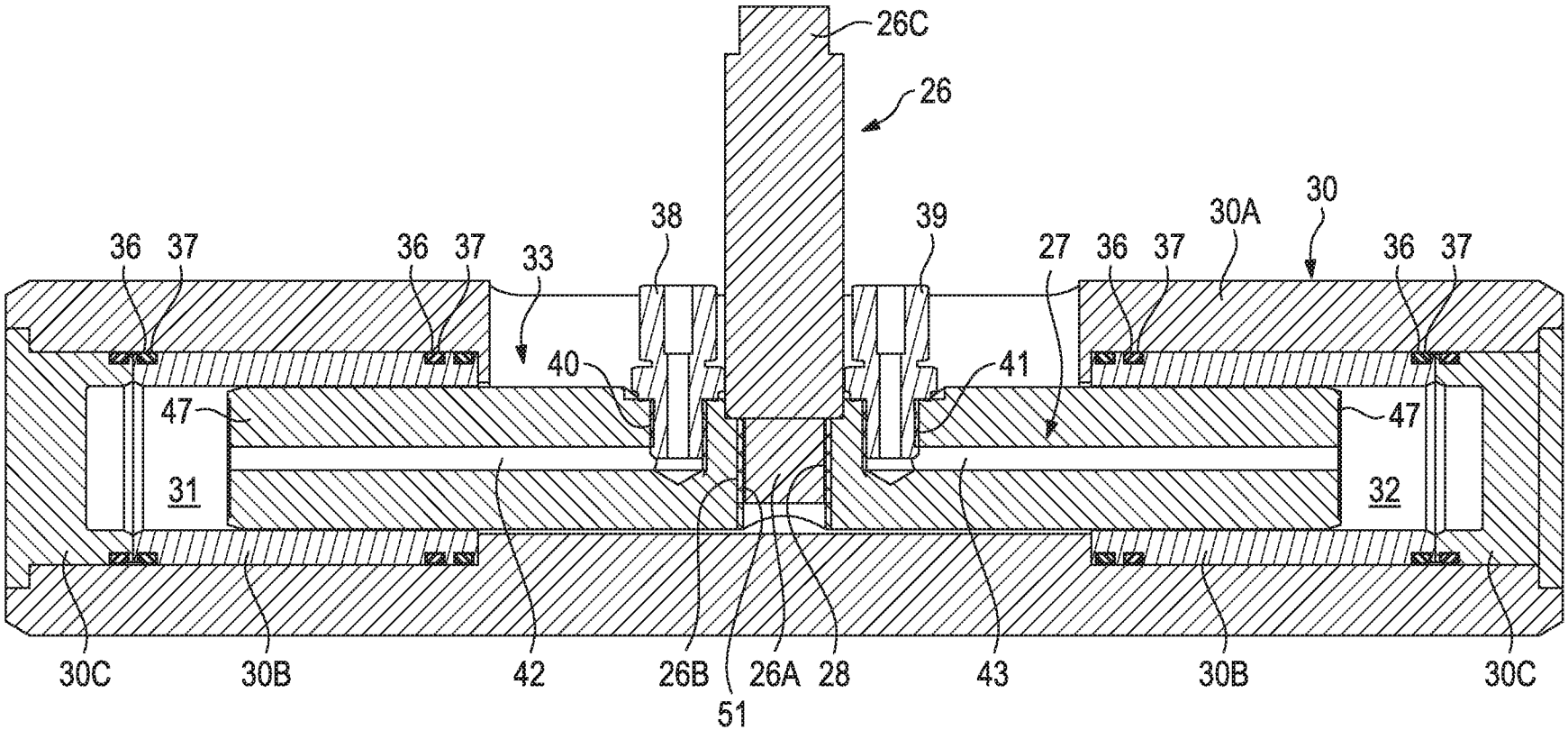
FIG. 10 shows a second embodiment of the actuating unit according to the invention.

FIG. 10 shows a second embodiment of the actuating unit, which only differs from the first embodiment in terms of construction, but not function. The mutually corresponding parts are denoted by the same reference signs. The second embodiment differs from the first embodiment in that the cylinder 30 comprises an outer cylinder part 30A and two inner cylinder parts 30B, 30C on one side and two inner cylinder parts 30B, 30C on the other side. The multi-part design of the cylinder 30 is advantageous in terms of manufacturing, since the grooves 37 for the seal packages 36 can be easily inserted. In this embodiment, the first and the second cylinder chamber 31, 32 extends as far as the inner cylinder part 30C positioned on the outside. The inner cylinder parts 30C positioned on the outside function in the same way as cover parts or caps, which can be screwed to the outer cylinder part 30A. In the embodiment in FIG. 10, the retaining part 26 comprises a shoulder 26A having an outer thread 26B on one end and the piston 27 comprises an inner thread 51, in order for it to be possible to screw the two parts to one another. The other end has a hexagon profile 26C for a spanner.

The lower scraper element 11 and upper scraper element 12 may be referred to as lower and upper scraper blade parts or simply lower and upper blade parts 11 and 12. The piston/cylinder arrangements 17 may also be referred to as lifting actuators 17 for lifting the lower blade part 11 relative to the upper blade part 12. The upper ends of the lifting actuators 17 are pivotally connected to the drum housing 5, and the lower ends of the lifting actuators are pivotally connected to the lower blade part 11.

The cylinder 30 and its interlocking engagement with the cut-out 48 of the milling drum housing may be described as a frame lock. The cylinder 30 and its interlocking engagement with the entraining elements 52 of the lower blade part 11 may be referred to as a blade lock.

The frame lock has a locked position wherein the upper blade part 12 is locked relative to the machine frame 2 by engagement of the cylinder 30 with the cut-out 48, and an unlocked position wherein the upper blade part is unlocked and can pivot relative to the machine frame 2 about the pivot axis 13.

The blade lock has a locked position as seen in FIG. 4 wherein upward sliding motion of the lower blade part 11 relative to the upper blade part 12 is blocked by engagement of the cylinders 30 with the entraining elements 52, so that upward force applied to the lower blade part 11 by the lifting actuators 17 causes the upper blade part 12 and the lower blade part 11 to pivot together relative to the machine frame 2 about the pivot axis 13. The blade lock can be in its locked position only when the frame lock is in its unlocked position.

The entraining elements 52 may be described as lower blade lock members 52, and the portions of the cylinders 30 engaged by the entraining elements 52 may be described as upper blade lock members. The laterally inward movement of the cylinders 30 brings the cylinders 30 into the paths of the entraining elements 52 such that upward movement of the lower blade part 11 relative to the upper blade part 12 brings the entraining elements 52 into locking engagement with the cylinders 30. When the blade lock is in its locked position the lower blade part 11 is in an intermediate position between its downward extended position and its upward retracted position relative to the upper blade part.

The lifting actuators 17 can be described as having a lifting stroke corresponding to movement of the lifting actuators 17 between the downward extended position of the lower blade part 11 and the upward retracted position of the lower blade part 11. The blade lock is configured such that when the frame lock is in its unlocked position a first part of the lifting stroke brings the blade lock into its locked position and a further part of the lifting stroke pivots the scraper blade about the pivot axis.

The invention claimed is:

1. A lock actuating unit for locking a component of a construction machine, comprising:

a retaining part configured to be fastened to the construction machine;

a piston fixed to the retaining part, the piston including a first piston end and a second piston end, the piston having a piston length from the first piston end to the second piston end;

a cylinder surrounding the piston such that a first cylinder chamber is formed on a first side of the piston and receives the first piston end and a second cylinder chamber is formed on a second side of the piston and receives the second piston end so that the cylinder can reciprocate along a longitudinal axis of the cylinder relative to the piston when the piston is longitudinally fixed relative to the construction machine, the cylinder including a cylindrical wall having a cut-out defined in the cylindrical wall, the cut-out extending along a cut-out length parallel to the longitudinal axis of the cylinder, the cut-out length being less than the piston length, the retaining part extending through the cut-out;

a first fluid connection in fluid communication with the first cylinder chamber; and a second fluid connection in fluid communication with the second cylinder chamber.

2. The lock actuating unit of claim 1, wherein:

the first and second fluid connections are provided on the piston and extend through the cut-out of the cylindrical wall.

3. The lock actuating unit of claim 2, wherein:

the first fluid connection is arranged on the piston on a first side of the retaining part and the second fluid connection is arranged on the piston on a second side of the retaining part;

a first fluid channel is defined in the piston on the first side of the retaining part and communicates the first fluid connection to the first cylinder chamber; and a second fluid channel is defined in the piston on the second side of the retaining part and communicates the second fluid connection to the second cylinder chamber.

4. The lock actuating unit of claim 1, wherein:

the retaining part includes an elongate body having a longitudinal body axis extending perpendicularly to the longitudinal axis of the cylinder.

5. The lock actuating unit of claim 4, wherein:

the elongate body of the retaining part is a cylindrical rod.

6. The lock actuating unit of claim 1, wherein:

the cylinder includes an outer cylinder part and at least a first inner cylinder part inserted into the outer cylinder part on a first side of the cut-out, and at least a second inner cylinder part inserted into the outer cylinder part on a second side of the cut-out, such that the cut-out is located between the first and second inner cylinder parts.

7. A lock actuating unit for locking a component of a construction machine, comprising:

a retaining part configured to be fastened to the construction machine;

a piston connected to the retaining part;

a cylinder surrounding the piston such that a first cylinder chamber is formed on a first side of the piston and a second cylinder chamber is formed on a second side of the piston, the cylinder including a cylindrical wall having a cut-out defined in the cylindrical wall, the cut-out extending parallel to a longitudinal axis of the cylinder, the retaining part extending through the cut-out;

a first fluid connection in fluid communication with the first cylinder chamber; and a second fluid connection in fluid communication with the second cylinder chamber;

wherein the cylinder includes an outer cylinder part and at least a first inner cylinder part inserted into the outer cylinder part on a first side of the cut-out, and at least a second inner cylinder part inserted into the outer cylinder part on a second side of the cut-out, such that the cut-out is located between the first and second inner cylinder parts; and wherein the piston includes a first end received in the first inner cylinder part and a second end received in the second inner cylinder part.

8. A combination, comprising:

a construction machine; and a lock actuating unit for locking a component of the construction machine, the lock actuating unit including:

a retaining part fastened to the construction machine;

a piston connected to the retaining part;

a cylinder surrounding the piston such that a first cylinder chamber is formed on a first side of the piston and a second cylinder chamber is formed on a second side of the piston, the cylinder including a cylindrical wall having a cut-out defined in the cylindrical wall, the cut-out extending parallel to a longitudinal axis of the cylinder, the retaining part extending through the cut-out;

a first fluid connection in fluid communication with the first cylinder chamber; and a second fluid connection in fluid communication with the second cylinder chamber;

wherein the construction machine is a self-propelled construction machine including at least first and second components, the first and second components being movably interconnected; and wherein the lock actuating unit is operably associated with the first and second components so as to selectively lock the first and second components together.

9. The combination of claim 8, wherein:

the first component includes a locking receptacle configured to receive the cylinder of the lock actuating unit;

and the second component is fastened to the retaining part of the lock actuating unit, such that the cylinder is pushed into the locking receptacle of the first component when the first cylinder chamber is supplied with a fluid such that the first and second components are locked together, and such that the cylinder is pulled back out of the locking receptacle of the first component when the second cylinder chamber is supplied with fluid such that the first and second components are unlocked from each other.

10. The combination of claim 9, wherein:

the second component includes at least one support part including a support opening into which the cylinder can slide.

11. The combination of claim 9, wherein:

the second component includes a mount fastened to the retaining part of the lock actuating unit.

12. The combination of claim 8, wherein:

the construction machine includes:

a machine frame having a working direction;

a plurality of running gears for supporting the machine frame from a ground surface;

a milling drum for milling the ground surface, the milling drum having a milling drum axis; and a milling drum housing in which the milling drum is arranged, the milling drum housing including a scraper plate arranged behind the milling drum with reference to the working direction, the scraper plate including an upper scraper element and a lower scraper element, the upper scraper element being fastened to the machine frame or the milling drum housing so as to be pivotable about a pivot axis parallel to the milling drum axis, and the lower scraper element being movable relative to the upper scraper element between a lowered position and a raised position, the lower scraper element being lowered onto the ground surface when in the lowered position;

wherein the machine frame or the milling drum housing includes at least one locking receptacle for receiving the cylinder of the actuating unit;

wherein the retaining part of the lock actuating unit is fastened to the upper scraper element such that the cylinder is pushed into the locking receptacle when the first cylinder chamber is supplied with fluid so that the upper scraper element is locked, and such that the cylinder is pulled back out of the locking receptacle when the second cylinder chamber is supplied with fluid so that the upper scraper element is unlocked; and further including a scraper plate actuator assembly configured such that when the upper scraper element is locked the lower scraper element can be moved by the scraper plate actuator assembly between the lowered and raised positions, and such that when the upper scraper element is unlocked the lower and upper scraper elements can be pivoted together by the scraper plate actuator assembly about the pivot axis.

13. The combination of claim 12, wherein:

the scraper plate actuator assembly includes a first piston/cylinder arrangement connected between the upper and lower scraper elements and a second piston/cylinder arrangement connected between the upper and lower scraper elements and spaced from the first piston/cylinder arrangement;

the first mentioned lock actuating unit is arranged in a first region between the first piston/cylinder arrangement and a first side part of the machine frame or the milling drum housing; and further including a second lock actuating unit arranged in a second region between the second piston/cylinder arrangement and a second side part of the machine frame or the milling drum housing.

14. The combination of claim 13, wherein:

the cylinders of each of the piston/cylinder arrangements are pivotally connected to the machine frame or the milling drum housing to pivot about a connection axis parallel to the pivot axis; and the pistons of each of the piston/cylinder arrangements are fastened to a lower portion of the lower scraper element.

15. The combination of claim 14, wherein:

the first and second lock actuating units are arranged on a lower portion of the upper scraper element.

16. A combination, comprising:

a construction machine; and a lock actuating unit for locking a component of the construction machine, the lock actuating unit including:

a retaining part configured to be fastened to the construction machine;

a piston connected to the retaining part;

a cylinder surrounding the piston such that a first cylinder chamber is formed on a first side of the piston and a second cylinder chamber is formed on a second side of the piston, the cylinder including a cylindrical wall having a cut-out defined in the cylindrical wall, the cut-out extending parallel to a longitudinal axis of the cylinder, the retaining part extending through the cut-out;

a first fluid connection in fluid communication with the first cylinder chamber; and a second fluid connection in fluid communication with the second cylinder chamber;

wherein the construction machine includes:

a machine frame;

a drum casing attached to the machine frame;

a milling drum mounted to rotate about a milling drum axis, the milling drum axis being fixed relative to the machine frame;

a scraper blade located behind the milling drum with reference to a direction of travel of the construction machine, the scraper blade including an upper blade part and a lower blade part, the lower blade part being movable in a sliding motion relative to the upper blade part, the upper blade part being pivotally mounted to pivot relative to the machine frame about a pivot axis; and a lifting actuator connected between the drum casing and the lower blade part to slide the lower blade part relative to the upper blade part between a downward extended position and an upward retracted position;

wherein the lock actuating unit provides:

a frame lock having a locked position wherein the upper blade part is locked relative to the machine frame, and an unlocked position wherein the upper blade part is unlocked and can pivot relative to the machine frame about the pivot axis; and a blade lock having a locked position wherein upward sliding motion of the lower blade part relative to the upper blade part is blocked so that upward force applied to the lower blade part by the lifting actuator causes the upper blade part and lower blade part to pivot together relative to the machine frame about the pivot axis.

17. The combination of claim 16, wherein:

the blade lock is configured such that the blade lock can be in its locked position only when the frame lock is in its unlocked position.

18. The combination of claim 16, wherein:

the blade lock includes a lower blade lock member attached to the lower blade part for moving with the lower blade part, and an upper blade lock member mounted on the upper blade part and movable laterally relative to the scraper blade such that the upper blade lock member can be moved into the path of the lower blade lock member such that upward movement of the lower blade part relative to the upper blade part brings the lower blade lock member into locking engagement with the upper blade lock member, the upper blade lock member including the cylinder of the lock actuating unit.

19. The combination of claim 18, wherein:

the blade lock is configured to be in its locked position when the lower blade part is in an intermediate position between the downward extended position and the upward retracted position relative to the upper blade part.

20. The combination of claim 18, wherein:

the upper blade lock member is defined on one end of the cylinder of the lock actuating unit and the frame lock includes an opposite end of the cylinder of the lock actuating unit.

21. The combination of claim 16, wherein:

the lifting actuator comprises a piston-cylinder unit.

22. The combination of claim 16, wherein:

the pivot axis is fixed in height relative to the machine frame.

23. The combination of claim 16, wherein:

the upper blade part is pivotally connected at the pivot axis to the drum casing.

24. The combination of claim 16, wherein:

the lifting actuator has a lifting stroke corresponding to movement of the lifting actuator between the downward extended position of the lower blade part and the upward retracted position of the lower blade part; and the blade lock is configured such that when the frame lock is in its unlocked position a first part of the lifting stroke brings the blade lock into its locked position and a further part of the lifting stroke pivots the scraper blade about the pivot axis.

* * * * *